United States Patent [19]

Luca

[11] 3,991,539

[45] Nov. 16, 1976

[54] METHOD AND APPARATUS IMPROVEMENTS IN CASE PACKING LIGHTWEIGHT FRAGILE ARTICLES

[75] Inventor: James J. Luca, Meriden, Conn.

[73] Assignee: Monsanto Company, St. Louis, Mo.

[22] Filed: Nov. 7, 1975

[21] Appl. No.: 629,799

[52] U.S. Cl. ..... 53/26; 53/35; 53/166; 53/248; 221/298

[51] Int. Cl.[2] ..... B65B 35/30; B65B 35/54

[58] Field of Search ..... 53/26, 35, 159, 166, 53/248; 221/298

[56] References Cited

UNITED STATES PATENTS

| | | | |
|---|---|---|---|
| 2,540,743 | 2/1951 | Leach | 53/48 |
| 2,656,081 | 10/1953 | Davis | 53/247 |
| 2,701,085 | 2/1955 | Davis | 53/166 |
| 3,273,308 | 9/1966 | Hoette | 53/261 |
| 3,869,843 | 3/1975 | Darrah et al. | 53/26 |
| 3,926,336 | 12/1975 | Graham et al. | 221/298 X |

*Primary Examiner*—Travis S. McGehee
*Attorney, Agent, or Firm*—Michael J. Murphy

[57] ABSTRACT

In case packing apparatus which includes a stop subjacent a plurality of vertical container accumulating channels, pockets below the stop for accepting containers on release by the stop and means for discharging the containers from the pockets to a case, the improvement comprising a container drop escapement vertically reciprocable between the channels and the pockets. The method involves isolating stacks of fragile containers situated in the accumulating channels from the lower layer prior to deposition of the latter in the packing case to minimize impact damage.

10 Claims, 5 Drawing Figures

METHOD AND APPARATUS IMPROVEMENTS IN CASE PACKING LIGHTWEIGHT FRAGILE ARTICLES

BACKGROUND OF THE INVENTION

This invention relates to packing articles such as jars, bottles and the like in shipping cases or trays such as those made of cardboard or corrugated board, and more particularly to method and apparatus improvements for minimizing damage to fragile articles during such packing.

As disclosed in U.S. Pat. No. 3,869,843, it is known to accumulate articles such as lightweight plastic bottles in end to end relationship in stacks above a loading station and to sequentially release the bottom layer to pockets in a packing grid from whence they are forcibly discharged to a shipping case.

Though such an assembly generally functions well under most conditions, a deficiency exists with thin-walled plastic containers susceptible to damage when roughly handled. More specifically, the stack length (vertical and horizontal components) above the grid loading station can reach to as great as the equivalent of some 200 containers should, for example, the packing system be temporarily shut down while containers continue to be received from the upstream work station. When containers are fed to the stacks under positive pressure, the total pressure on the bottom stack layer, due to such positive pressure plus the dead weight of the stack per se, can approach about 20 pounds or more depending on the relative magnitudes of the pressure components. When the stop at the base of the stack is then removed to charge the packing grid, the base and/or neck portions of the fragile containers frequently fracture when the bottom layer strikes the next lower abutment in the system adjacent containers in prior layers strike each other, thus rendering them unusable. In addition, substantial noise is generated due to the impacting surfaces.

SUMMARY OF THE INVENTION

Now, however, method and apparatus improvements have been developed to substantially eliminate breakage during case packing fragile articles.

Accordingly, it is a principal object of this invention to provide method and apparatus improvements in packing lightweight fragile articles such as thin-walled plastic bottles into cases, which improvements minimize article breakage.

An additional object is to provide method and apparatus improvements which alleviate the effect of energy on the bottom bottle as well as preceding bottles stored in the infeed stack during packout of such bottom bottle from the stack.

A specific object is to provide method and apparatus improvements which accomplish anti-shock, damage resistant loading of fragile articles from the bottom of a series of accumulated stacks of such articles to the pockets of a packing grid.

Other objects will in part be obvious and will in part appear hereinafter from the following description and claims.

These and other objects are accomplished in a process for case packing articles which comprises cyclically releasing the lower layer of fragile lightweight articles accumulated in stacks to a case or packing grid below, by providing the improvement comprising, in combination, the step of isolating the stacks from each lower layer prior to each cyclical release to prevent damage to the fragile articles.

Also, there is provided in case packing apparatus comprising stop means subjacent a plurality of substantially vertical container accumulating channels, pockets below such stop means for accepting containers on release by the stop means, and means for discharging the containers from the pockets to a case, the improvement comprising, in combination, a container drop escapement vertically reciprocable between the channels and the pockets.

BRIEF DESCRIPTION OF THE DRAWINGS

In describing the overall invention, reference will be made to the accompanying drawings wherein.

DETAILED DESCRIPTION OF ILLUSTRATED EMBODIMENTS

Figure 1:
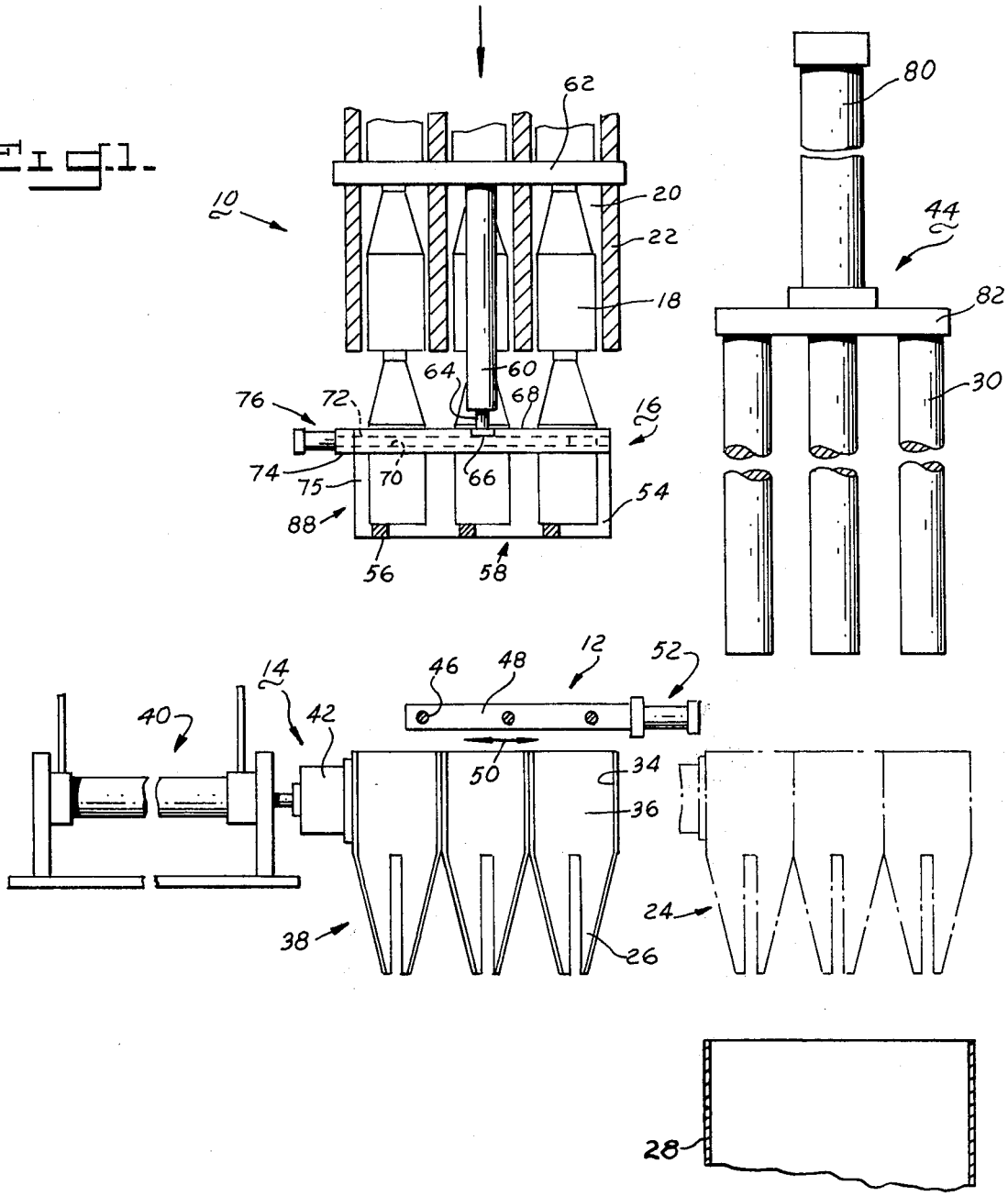
FIGS. 1–4 are vertical, schematic views of apparatus embodying the invention during successive steps in a preferred packing cycle.
Figure 3:
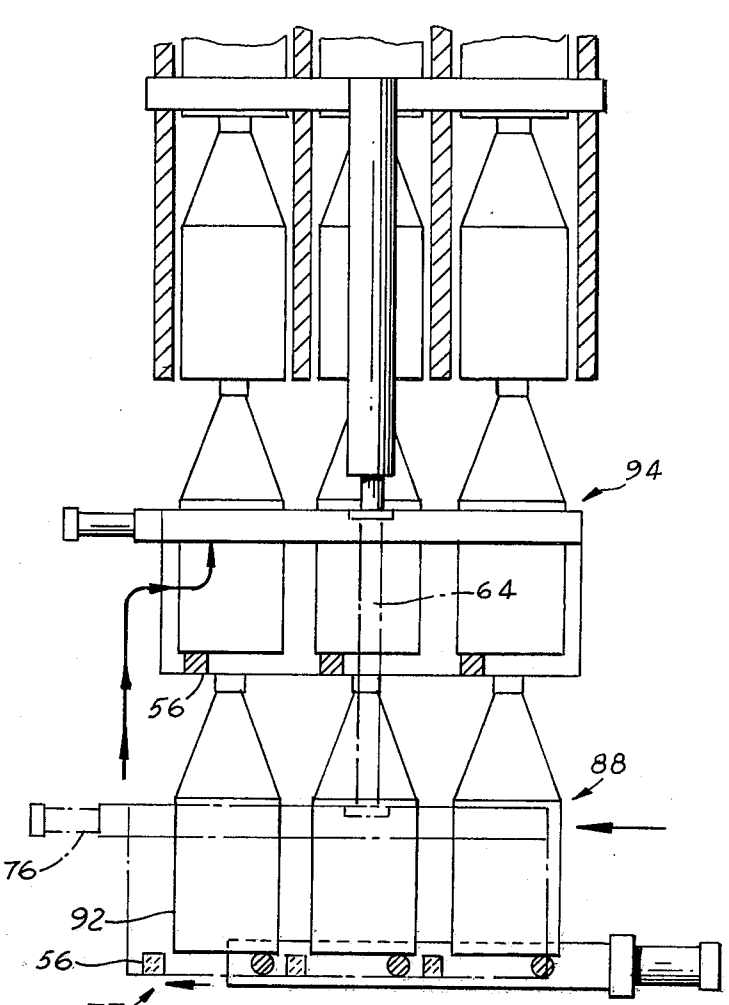

Referring now to the drawings, there is shown in FIG. 1, case packing apparatus collectively identified as 10, and generally comprising stop means or gate mechanism 12, grid assembly 14, and container drop escapement 16 above stop means 12 for gently lowering fragile articles, for example containers such as lightweight plastic bottles 18, to stop means 12.

A plurality of substantially vertical container accumulating channels 20 are above escapement 16 with each channel 20 circumscribed, in the illustrated embodiment, by substantially vertical guides 22, circularly equi-spaced, for example at 120°, from each other. Though details of the members forming channels 20 may vary, likewise suitable are closed tubes having an internal open cross section slightly larger than the maximum body dimensions of bottles 18. Channels 20 preferably extend vertically a rather substantially distance, not shown, and sever to provide surge space for bottles 18 between an upstream work station, not shown, from which the bottles are fed and the station 38 for grid assembly 14 below channels 20. Though the number of channels 20 may vary with the capacity of the system, it is intended that twelve exist in the illustrated embodiment, three horizontally across, as shown, and four deep, not shown, in a direction perpendicular to the plane of FIG. 1.

Grid assembly 14 below stop means 12 receives successive charges of twelve bottles 18 from channels 20 and, after shifing sideways, to the right to the dottled line position identified as station 24 in FIG. 1, then discharges each such charge through inwardly, biased, resilient steel fingers 25, well known in the art, to a case 28 preferably vertically positioned below discharge station 24. Fingers 26 (FIG. 1) prevent bottles 18 from prematurely exiting assembly 14 and, with vertical extensions 34, form pockets 36 equivalent in number to the number of channels 20 which happen to be in use. In FIGS. 1 – 5, grid assembly 14 and therefore pockets 36 are vertically fixed but laterally movable between loading station 38 and discharge station 24. Shifting movement between such stations may be accomplished by any suitable means such as linear actuator 40 (FIG. 1) comprising a conventional cylinder-piston arrangement connected to member 42 of grid assembly 14 conventionally operable from a suitable source of pressurized fluid.

Means 44 above station 24 (FIG. 1) for forcibly ejecting bottles 18 from pockets 36 comprises a linear actuator 80 securred to platform 82 to which are fixed projecting plungers 30 vertically aligned with pockets 36 and bottles 18 therein when assembly 14 is in station 24. Though not shown, an assembly identical with that identified as 44 in FIG. 2 can be provided to the immediate left of station 38. With such latter arrangement, as is known, double grid assemblies are provided with each being slidable back and forth on rails to and from a discharge station on either side of loading station 38, so that as one grid assembly is being discharged, the other is being simultaneously loaded.

Stop means 12 subjacent channels 20, in the illustrated embodiment showing three channels 20 across, comprises three bars 46 longitudinally extending rearwardly from the plane of FIG. 1 and supported on either end in a bracket 48 which is cyclically shiftable laterally back and forth in the direction of arrows 50 in FIG. 1 via conventional piston-cylinder assembly 52 operatively secured to bracket 48.

Figure 4:
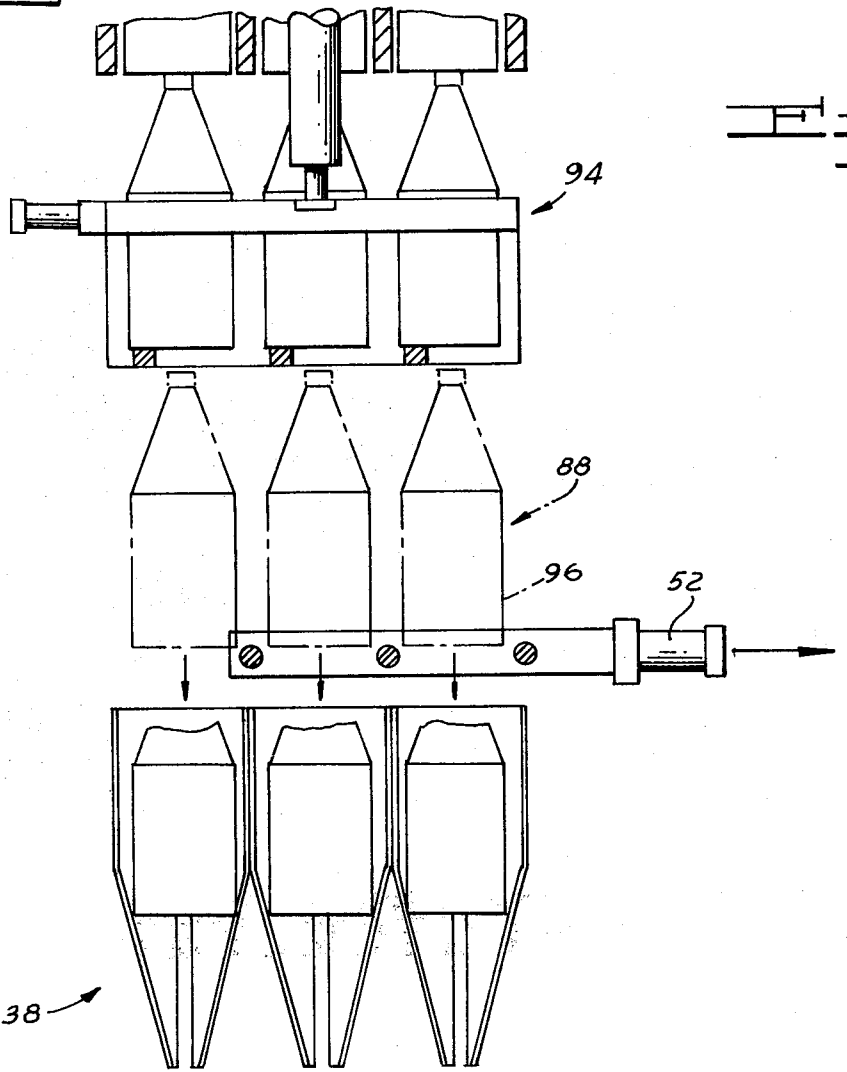

In accordance with the invention, container drop escapement 16 in FIGS. 1 – 4 is between the lower ends of channels 20 and stop means 12 and includes a frame 58 comprising a pair of horizontally spaced, vertically extending endplates, with one being identified at 54 in FIG. 1, carrying three laterally spaced horizontal bars 56 spanning the distance between such plates 54 and parallel with bars 46 of stop means 12. As illustrated in FIGS. 1 and 4, during part s of the cycle to be yet described, a portion of a bar 56 is positioned below each row of channels 20. Escapement 16 further comprises means for shifting frame 58 laterally back and forth between the positions shown in FIG. 1 and at 77 in FIG. 3, as well as vertically toward and away from stop means 12 between channels 20 and pockets 36. Such means in the embodiment illustrated, comprises a conventional motion translating mechanism such as fluid cylinder 60 mounted to bracket 62 secured to members 22 plus piston 64 reciprocable in cylinder 60 and having its forward end 66 secured to cross member 68. An equivalent cylinder-piston and support arrangement, not shown, exists on the opposite side of frame 58. Each such member 68 has a horizontal track 70 formed therein for slidably receiving link member 72. Carrier member 74 extending rearwardly of the plane of FIG. 1 mounts linear actuator 76 and is secured to side plate 75 of frame 58 and to brackets 68 so that when actuator 76 is extended or retracted via a conventional pressurized air or hydraulic medium, frame 58 and rods 56 shift laterally with respect to bars 46 via sliding movement of member 72 in the track of cross member 68 between the positions shown in FIGS. 1 and 3. Alternative mechanisms such as cam operated linkage, transmission chains and sprockets and the like could be used in place of the illustrated frame shifting means.

Figure 2:
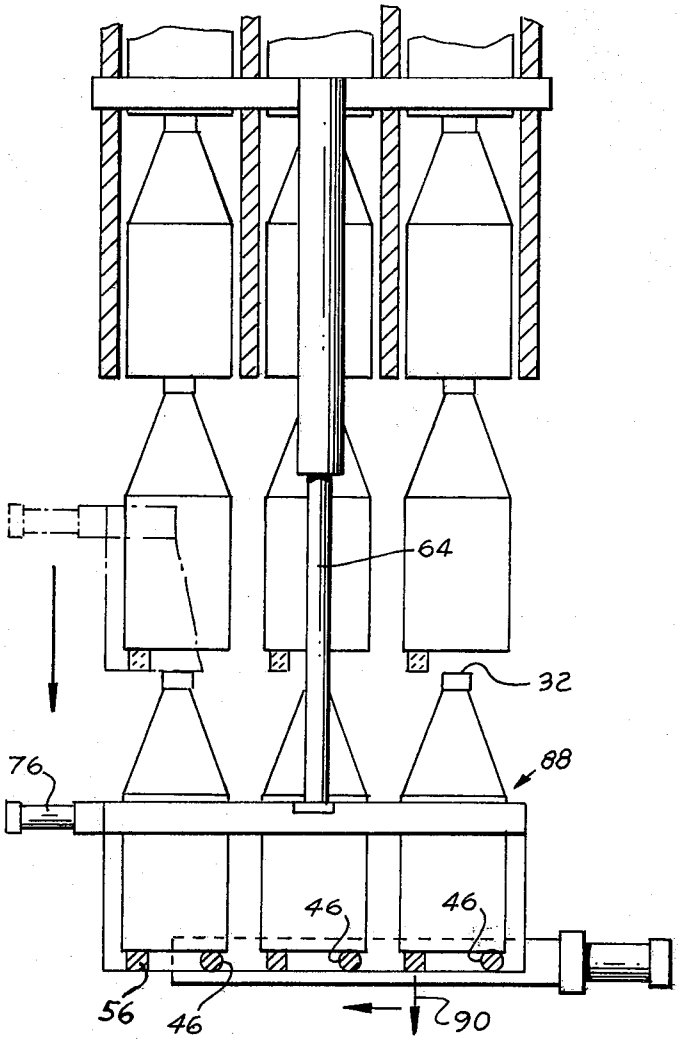

In operation, the proces for case packing containers comprises accumulating fragile, lightweight articles such as thin-walled plastic bottles 18 in storage position in abutting end to end engagement, preferably base first as shown in FIG. 1, in plural, vertical, layered stacks, guidedly received with channels 20, and then repeatedly carrying out a cycle of steps, to be described, each of which occurs during one working cycle. Bottles 18 may be presented to channels 20 in any of many ways such as by conveying under pressure, hand introduction, gravity drop from supply elevators and the like. At the start of a packing cycle, piston 64 is in the retracted position of FIG. 1 such that bars 56 support the plural stacks beneath the lower layer, the latter identified as 88 in FIG. 1. In the specific embodiment of FIGS. 1 – 4, each bar 56 supports three stacks of bottles depthwise to the plane of the Figures. In such positions, portions of bars 56 interferingly abut the outer face of the bottle base to the left of the center of the cylindrical container. Next, via suitable conventional control elements, not shown, pressurized fluid conventionally supplied to cylinder 60, causes piston 64 and therefore frame 58 to shift downwardly (the extent of which may be varied) to the solid line position of FIG. 2, thereby lowering each of the supported stacks to stop means 12. Downward movement of the stacks is at a controlled rate depending on the fragility of the articles being packaged, and is achieved, for example, via a fixed or variable restriction in the pressurized fluid supply or discharge lines to cylinder 60, not shown. As illustrated in FIG. 2, since bars or blocking members 46 are positioned in the path of the downwardly moving stacks, support of each entire stack is smoothly transferred to such members 46 from bars 56 of escapement 16, such new support existing via abutment of the right side of the cylindrical base of each lowered bottle 18 in a layer against portions of bars 46. Bars 56 of drop escapement 16 preferably continue downwardly for a short distance after initial deposition of the bottles of the lowered layer on bars 46 to a point just past the horizontal plane of bars 46 to insure complete elimination of all free fall of the stacks, even to the extent of the thickness of the bars, whereupon actuator 76 is activated (FIG. 3) to shift bars 56 laterally to the left to position 77 in FIG. 3 out from under the lowered layer of bottles at least until each bar 56 clears the adjacent bottle sidewall 92. Piston 64 is then retracted with the bars in the FIG. 3 position to life frame 58 upwardly to the elevation of the FIG. 1 position at which point actuator 76 is again activated to shift bars 56 inwardly in the reverse direction to the right in FIG. 3 to the shown solid line position adjacent the reduced diameter annular neck portions at the upper extremities of the lowered layer 88 and beneath the next upper layer 94 of bottles in the stacks, thereby reestablishing support of the stacks via bars 56 above lowered layer 88. Momentarily later, (FIG. 4) actuator 52 is energized to slide blocking members 46 laterally to the right to bottl-release positions out from under the containers until clear of container sidewall portions 96. Such movement then allows lowered layer 88 to drop by gravity free of the stack forces since such stacks are then supported above, into pockets 36 until their descent is broken by engagement with fingers 26 of grid assembly 14 coaxially situated below. At this point grid assembly 14 is reciprocated to the right via assembly 40 to discharge station 24 whereupon plungers 30 are caused to reciprocate downwardly against the upper faces 32 of bottles 18 to force the bottles of layer 88 guidedly through fingers 26 and into packing case 28, which may have internal separating partitions, not shown. As layer 88 is being charged to case 28 the next cycle of the members in filling station 38 is occuring in an overlapping manner to promote system efficiency.

Thus, impact forces transmitted to layer 88 and the prior upper layers are eliminated, which forces would otherwise occur if layer 88 were uncontrollably dropped to grid assembly 14 under the influence of the stack weight plus any pressure component acting thereon; stack jerking, abrupt descent, noise and breakage are avoided with the positive controlled lowering of each layer in the manner described.

Figure 5:
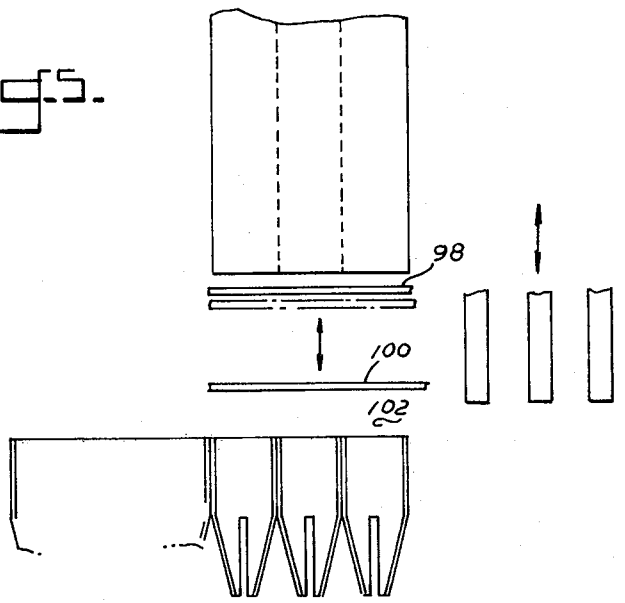
FIG. 5 is a schematic view of an alternative form of the invention.

Though container drop escapement 16 has been shown in the embodiment of FIGS. 1 – 4 above stop means 12, it will function equally as well when between such stop means 12 and the packing frame in the manner schematically illustrated in FIG. 5. In such figure, the equivalent of stop means 12 is shown as 98, that of drop escapement 16 as 100 and that of packing frame 14 as 102. With this arrangement of the components, stack isolation during controlled lowering of the bottom layer via means 100 is accomplished via horizontal bars, not shown, of means 98 which are caused to shift laterally to transfer stack support to means 100 after the latter has gravity-released the lowered charge to frame 102 and returned upwardly to a position between bars of means 98.

The various movements of the components of the system described are preferably entirely automated by conventional position-sensing elements and associated control devices so as to initiate and synchronously coordinate with other movements at the exact desired instant in the packing cycle. Also, conveyors to present empty and remove filled packing cases can be supplied in conventional manner to further automate the system, as can equipment to raise and lower such cases with respect to the grid assemblies. Though grid assemblies or packing frames have been shown in the illustrated embodiments, it may be possible to drop-release the lowered containers directly to the cases from the stop means without employing such assemblies at all. Guide extensions for the containers during their controlled descent between the lower ends of the accumulating channels and the stop or gate means allowing the described shifting movements of the drop escapement may also be used as necessary.

Various modifications and alterations will be readily suggested to persons skilled in the art. It is intended, therefore, that the foregoing be considered as exemplary only and that the scope of the invention be ascertained from the following claims.

I claim:

1. In a process for case packing bottles which comprises:

cyclically releasing lower layers of fragile, lightweight bottles accumulated in substantially vertical stacks to a plurality of pockets below; and simultaneously ejecting the bottles from the pockets to a case;

the improvement in said process wherein bottle impact damage is substantailly prevented during release to the pockets, comprising, in combination, the steps of:

a. gently lowering said stacks at a controlled rate; and b. isolating each lower layer from the stacks after lowering and prior to each cyclical release.

2. A process for case packing containers comprising repeatedly carrying out the steps of:

a. supporting stacks of lightweight containers beneath the lower layer;

b. lowering each supported stack at a controlled rate to a blocking member below;

c. transferring support of the stacks to the blocking member;

d. re-establishing support of the stacks above the lowered layer; and e. shifting the blocking member to a release position to permit the lowered layer to drop into pockets below.

3. The process of claim 2 wherein the containers are lowered a distance of substantially the height of one container.

4. The process of claim 2 wherein step (c) is accomplished by laterally shifting bars out from beneath the lower container in each stack.

5. The process of claim 2 wherein step (d) is accomplished by:

raising a support member substantially one container length from a level substantially opposite the blocking member; and laterally shifting bar portions of the support member inwardly into supporting position beneath the next lowermost container in each stack from intermediate positions between the stacks.

6. In case packing apparatus comprising:

stop means subjacent a plurality of substantially vertical container accumulating channels;

pockets below said stop means for accepting containers on release by said stop means; and means for discharging the containers from the pockets to a case;

the improvement in said apparatus comprising, in combination:

a container drop escapement vertically reciprocable between a loading position from said channels above the stop means and a position discharging the containers to the stop means above the pockets.

7. The apparatus of claim 6 wherein said pockets are vertically fixed and horizontally movable.

8. The apparatus of claim 7 wherein said escapement comprises:

i. a frame having a series of substantially horizontal bars, each channel having a bar portion positioned below it; and ii. means for shifting the frame laterally and vertically.

9. In case packing apparatus comprising:

stop means cyclically operable subjacent a plurality of substantially vertical container accumulating channels;

a grid assembly below the stop means for accepting containers from the channels and discharging them to a case;

the improvement in said apparatus comprising, in combination:

a vertically reciprocable container drop escapement for gently lowering said containers an extent substantially equal to the height of one of said containers from the channels.

10. The apparatus of claim 9 wherein the grid assembly is laterally shiftable between loading and discharge stations.

* * * * *